US006347295B1

(12) United States Patent
Vitale et al.

(10) Patent No.: US 6,347,295 B1
(45) Date of Patent: Feb. 12, 2002

(54) COMPUTER METHOD AND APPARATUS FOR GRAPHEME-TO-PHONEME RULE-SET-GENERATION

(75) Inventors: Anthony J. Vitale; Ginger Chun-Che Lin, both of Northboro; Thomas Kopec, Amherst, all of MA (US)

(73) Assignee: Compaq Computer Corporation, Houston, TX (US)

( * ) Notice: Subject to any disclaimer, the term of this patent is extended or adjusted under 35 U.S.C. 154(b) by 0 days.

(21) Appl. No.: 09/179,153

(22) Filed: Oct. 26, 1998

(51) Int. Cl.[7] ..... G10L 19/06
(52) U.S. Cl. ..... 704/209; 704/265
(58) Field of Search ..... 704/209

(56) References Cited

U.S. PATENT DOCUMENTS 5,721,939 A * 2/1998 Kaplan ..... 395/759
5,781,884 A * 7/1998 Pereira et al. ..... 704/260
5,799,267 A * 8/1998 Siegel ..... 704/1
5,953,692 A * 9/1999 Siegel ..... 704/1
6,018,736 A * 1/2000 Gilai et al. ..... 707/6
6,078,885 A * 6/2000 Beutnagel ..... 704/201
6,108,627 A * 8/2000 Sabourin ..... 704/243

* cited by examiner

*Primary Examiner*—Fan Tsang
*Assistant Examiner*—Michael N. Opsasnick
(74) *Attorney, Agent, or Firm*—Sharp, Comfort & Merrett, P.C.

(57) ABSTRACT

A computer method and apparatus provide automatic generation of grapheme-to-phoneme rules, used in text-to-speech synthesis systems. The invention method and apparatus are based on a statistical analysis of a subject dictionary. The dictionary preferably contains words and their corresponding phonemic data representations, and is analyzed for subgraph patterns. The phoneme strings for words containing the subgraph patterns are then analyzed for common phoneme substrings (subphones) associated with each subgraph. The subphones associated with each subgraph are then checked for conditions such as the highest occurrence count, the proper length, and for compatibility with both ends of the subgraph to which they are associated. A subphone matching these conditions becomes paired with the subgraph to create a rule for text-to-speech processing. Separate prefix, infix, and suffix rule sets may be generated from the invention dictionary analysis.

19 Claims, 6 Drawing Sheets

COMPUTER METHOD AND APPARATUS FOR GRAPHEME-TO-PHONEME RULE-SET-GENERATION

RELATED APPLICATIONS

The below described work is related to the subject matter disclosed in the following patent applications of the same assignee as the present invention, the contents of which are incorporated herein by reference:

Title: RULES BASED PREPROCESSOR METHOD AND APPARATUS FOR A SPEECH SYNTHESIZER

Inventor: Ginger Chun-Che Lin and Matthew G. Schnee U.S. application Ser. No.: 09/037,900, filed Mar. 10, 1998

Title: COMPUTER METHOD AND APPARATUS FOR TRANSLATING TEXT TO SOUND

Inventor: Thomas Kopec and Ginger Chun-Che Lin application Ser. No. 09/071,441, filed May 1, 1998 issued as U.S. Pat. No. 6,076,060 on Jun. 13, 2000.

BACKGROUND OF THE INVENTION

Generally speaking, a "speech synthesizer" is a computer device or system for generating audible speech from written text. That is, a written form of a string or sequence of characters (e.g., a sentence) is provided as input, and the speech synthesizer generates the spoken equivalent or audible characterization of the input. The generated speech output is not merely a literal reading of each input character, but a language dependent, in-context verbalization of the input. If the input was the phone number (508) 691–1234 given in response to a prior question of "What is your phone number?", the speech synthesizer does not produce the reading "parenthesis, five hundred eight, close parenthesis, six hundred ninety-one . . . " Instead, the speech synthesizer recognizes the context and supporting punctuation and produces the spoken equivalent "five (pause) zero (pause) eight (pause) six . . . " just as an English-speaking person normally pronounces a phone number.

Historically the first speech synthesizers were formed of a dictionary, engine and digital vocalizer. The dictionary served as a look-up table. That is, the dictionary cross referenced the text or visual form of a character string (e.g., word or other unit) and the phonetic pronunciation of the character string/word. In linguistic terms the visual form of a character string unit (e.g., word) is called a "grapheme" and the corresponding phonetic pronunciation is termed a "phoneme". The phonetic pronunciation or phoneme of character string units is indicated by symbols from a predetermined set of phonetic symbols. To date, there is little standardization of phoneme symbol sets and usage of the same in speech synthesizers.

The engine is the working or processing member that searches the dictionary for a character string unit (or combinations thereof) matching the input text. In basic terms, the engine performs pattern matching between the sequence of characters in the input text and the sequence of characters in "words" (character string units) listed in the dictionary. Upon finding a match, the engine obtains from the dictionary entry (or combination of entries) of the matching word (or combination of words), the corresponding phoneme or combination of phonemes. To that end, the purpose of the engine is thought of as translating a grapheme (input text) to a corresponding phoneme (the corresponding symbols indicating pronunciation of the input text).

Typically the engine employs a binary search through the dictionary for the input text. The dictionary is loaded into the computer processor physical memory space (RAM) along with the speech synthesizer program. The memory footprint, i.e., the physical memory space in RAM needed while running the speech synthesizer program, thus must be large enough to hold the dictionary. Where the dictionary portion of today's speech synthesizers continue to grow in size, the memory footprint is problematic due to the limited available memory (RAM and ROM) in some applications.

The digital vocalizer receives the phoneme data generated by the engine. Based on the phoneme data together with timing and stress data, the digital vocalizer generates sound signals for "reading" or "speaking" the input text. Typically, the digital vocalizer employs a sound and speaker system for producing the audible characterization of the input text.

To improve on memory requirements of speech synthesizers, another design was developed. In that design, the dictionary is replaced by a rule set. Alternatively, the rule set is used in combination with the dictionary instead of completely substituting therefor. At any rate, the rule set is a group of statements in the form IF (condition)-then-(phonemic result) Each such statement determines the phoneme for a grapheme that matches the IF condition. Examples of rule-based speech synthesizers are DECtalk by Digital Equipment Corporation of Maynard, Massachusetts and TrueVoice by Centigram Communications of San Jose, Calif.

Each rule (If-then statement) is the result of years of linguistic studies and are largely "manually" generated. Thus the formation of a rule set is a very time consuming and language dependent process. Further, there are little standards in this area.

These and other problems exist in speech synthesizer technology. New solutions have been attempted but with little success. As a result, highly accurate speech synthesizers are yet to come.

In particular, typically a speech-synthesizer developer starts with a very large dictionary. A human linguist specializing in language and speech analysis examines words and their corresponding pronunciation in view of respective part of speech, spelling and other linguistic factors. As such, the linguist manually extracts rules from the dictionary or uses his knowledge of the language to create some rules. Next the speech-synthesizer developer removes from the dictionary the words that can be synthesized from the newly created rules. The more words able to be removed from the dictionary due to a created rule, the better.

The task of manually analyzing words of a language for grapheme-to-phoneme patterns is a laborious and painstaking one. It may take several months or years of manual human effort for a linguist to analyze a language and produce a grapheme-to-phoneme rule set for that language. Not only is this process lengthy and complicated, it is also prone to error where the created rules are manually typed into a rule file. Some of the typographical errors may be caught in compiling the rule file. Those that are not caught typically result in rules which will never be matched and hence never utilized during text-to-speech processing.

SUMMARY OF THE INVENTION

The foregoing problems of manual grapheme-to-phoneme rule generation are overcome by the present invention. The present invention provides a computer method and system for automated rule and rule set generation. Instead of having a human linguist manually analyze dictionary entries to determine grapheme-to-phoneme patterns and manually type the rules into a rule set, the present invention provides automatic digital processing means and a statistical approach to create the best possible rule set. In turn, the present invention enables creation of the smallest possible dictionary associated with a reasonable sized set of rules to substitute for a single huge dictionary of the prior art which cannot be used for many embedded applications. Even in the future, if large memory becomes inexpensive and available, the small memory footprint of the present invention rule set and resulting dictionary will still be an advantage since one may use the extra available memory to store other information such as a domain dictionary, abbreviation, phrase dictionary, etc.

In a preferred embodiment, each dictionary entry in an input dictionary is formed of (i) a sequence of one or more characters indicative of a subject character string, and (ii) a corresponding phonemic (phoneme string) representation formed of phonemic data parts. There is a different phonemic data part for each different subsequence of characters in the character string.

For each of the different subsequences of characters in the character string of a dictionary entry, the present invention (a) determines respective corresponding phonemic data parts found throughout the input dictionary for the subsequence of characters, and (b) from the determined respective corresponding phonemic data parts for the certain subsequence of characters, forms a grapheme-to-phoneme rule for indicating transformation from the certain subsequence of characters to at least one of the respective corresponding phonemic data parts. To that end the present invention generates grapheme-to-phoneme rules from the input dictionary. As such, the present invention effectively provides a rule generator.

By using the rule generator of the present invention, errors in rule creation are minimized, and a more accurate (less redundant and with fewer exceptions) set of rules is created. Also, rules may be generated by a computer according to the invention in far less time than manual human analysis of a dictionary.

In accordance with one aspect of the present invention, the input dictionary is formatted into a linked list. That is, each dictionary entry character string is linked to another entry character string to form a dictionary linked list.

Further, the determination of respective corresponding phonemic data parts of a subsequence of characters includes the steps of:

(a) for each character string entry in the dictionary linked list, comparing the character string entry to each of the succeeding character string entries in the dictionary linked list;

(b) for each comparison between a character string entry and a succeeding character string entry, determining a longest common subsequence of characters (preferably of three or more characters with one vowel) having a same respective location within the character string entries, the location being one of prefix, infix and suffix positions of a character string entry;

(c) storing in a linked list fashion, each determined longest common subsequence of characters and corresponding indication of location within the character string entries, each determined longest common subsequence of characters and its corresponding indication of location being a subgraph entry, such that a subgraph linked list is formed; and (d) sorting the subgraph entries of the formed subgraph linked list such that the subgraph entry having the longest common subsequence of characters is first in the subgraph linked list, and any subgraph entry repeating another subgraph entry is omitted.

In the preferred embodiment, the step of sorting further includes, for subgraph entries having subsequences of a same length, sorting the subsequences alphabetically.

In addition, for each subgraph entry in the subgraph linked list, the invention (a) determines which character string entries from the dictionary input have the subsequence of characters in the corresponding location of the subgraph entry; (b) for each determined character string entry, forming a word match entry, including indicating the corresponding phoneme of the determined character string entry; and (c) linking the formed word match entries to each other and to the subgraph entry, such that a word match linked list is formed for and coupled to the subgraph entry.

In the preferred embodiment, the invention method and system further include the steps of:

(i) for each word match entry in the word match linked list of the subgraph entry, comparing the phoneme indicated in the word match entry to phonemes indicated in succeeding word match entries, and finding a largest common phonemic data part of a same relative location in the phonemes;

(ii) for each found largest common phonemic data part, determining an occurrence count of the number of word match entries in which the phonemic data part occurs;

(iii) for each found largest common phonemic data part, forming a subphone entry indicating (a) the found largest common phonemic data part, (b) its corresponding location in the phonemes in terms of prefix, infix and suffix positions, and (c) the determined occurrence count; and (iv) linking the formed subphone entries to each other and to the subgraph entry, such that a subphone linked list is formed for and coupled to the subgraph entry.

In addition, for each word match entry in the word match linked list of a subgraph entry, the preferred embodiment (a) selects from the subphone linked list of the subgraph entry, a subphone entry having phonemic data parts matching the phonemic data parts of the phoneme indicated in the word match entry and having a same corresponding location as the subgraph entry; and (b) generates a grapheme-to-phoneme rule using the selected subphone entry, such that the rule indicates that the subsequence of characters in the subgraph entry occurring at its corresponding location within a character string, has a phonemic translation of the phonemic data parts of the selected subphone entry.

In accordance with another feature, the step of selecting a subphone entry further includes the steps of:

(a) if the corresponding location indicated in the subphone entry is prefix, verifying that a last phonemic data part of the subphone entry is a possible phonemic data part for a last character of the subgraph entry;

(b) if the corresponding location indicated in the subphone entry is suffix, verifying that a first phonemic data part of the subphone entry is a possible phonemic data part for a first character of the subgraph entry;

(c) if the corresponding location indicated in the subphone entry is infix, verifying that a last phonemic data part of the subphone entry is a possible phonemic data part for a last character of the subgraph entry, and that a first phonemic data part of the subphone entry is a possible phonemic data part for a first character of the subgraph entry;

(d) determining the subphone entry having a highest occurrence count; and (e) verifying that length of the phonemic data parts of the subphone entry is greater than length of the sequence of characters in the subgraph entry plus or minus a predetermined amount, depending on the language of the dictionary.

As such, the preferred embodiment forms a grapheme-to-phoneme rule for indicating transformation from the subsequence of characters to the phonemic data part most frequently corresponding to the subsequence of characters throughout the input dictionary.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout different views. The drawings are not meant to limit the invention to particular mechanisms for carrying out the invention in practice, but rather, are illustrative of certain ways of performing the invention. Others will be readily apparent to those skilled in the art.

DETAILED DESCRIPTION OF THE INVENTION

By way of overview, the present invention provides a computer system and method for automatically generating grapheme-to-phoneme rules and rule sets for use in speech synthesizers. The invention accepts a dictionary as input and creates grapheme-to-phoneme rules as output. The dictionary input comprises a plurality of entries. Each entry is formed of a respective character string and a corresponding phoneme string indicating pronunciation of the character string. As will be explained in detail below, by analyzing each entry's character string pattern and corresponding phoneme string pattern in relation to character string-phoneme string patterns in other entries, the invention is able to create grapheme-to-phoneme rules for a speech synthesizer. The rules may be grouped into rule sets, such as suffix, prefix, and infix rule sets.

Figure 1:
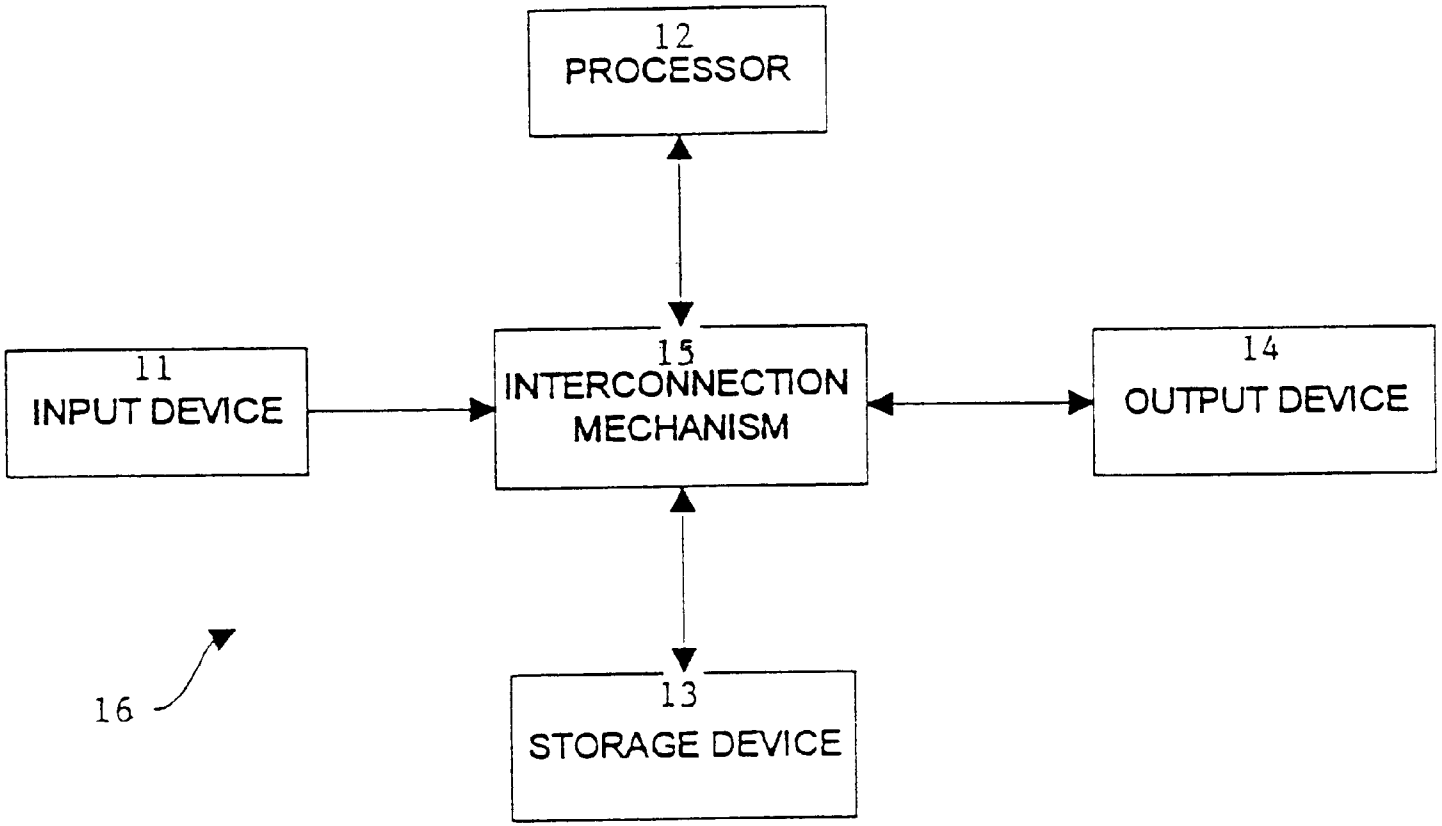
FIG. 1 is a block diagram of a computer system in which the present invention may be implemented.

Referring to FIG. 1, the present invention may be implemented on a digital processing computer system 16. The main components of such a computer system 16 include an interconnection mechanism 15, such as a data bus, which interconnects an input device 11, an output device 14, a digital processor 12 and a storage device 13. Complete operation of the invention with respect to FIG. 1 will be discussed in detail later. For now, the input device 11 may be a randomly accessible disk containing dictionary input, the output device 14 may be the same or a similar disk to store the rules generated by the present invention, and the storage device 13 may be working memory randomly accessed by the processor 12 to support operation/execution for rule generation of the present invention among other tasks.

Figure 2:
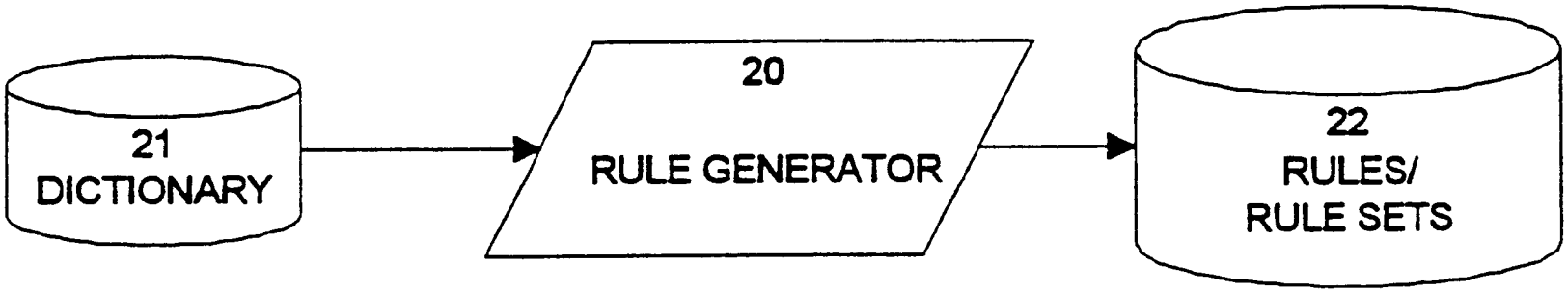
FIG. 2 is a schematic overview of the rule generation method and apparatus of the present invention.

FIG. 2 shows the general nature of the method and apparatus of the present invention at a high level. In FIG. 2, rule generator 20 reads and analyzes entries in dictionary 21 and generates grapheme-to-phoneme rules for rule sets 22 based on the invention analysis. The rule generator 20 may be, for example, a computer program executed on processor 12 of the computer system 16 in FIG. 1. A text-to-speech synthesizer (not shown) subsequently uses the generated rules/rule sets 22 to analyze and "speak" input text containing character strings written in the same language as the dictionary 21. That is, after the invention has completed its processing, the rules 22 are employable by a speech synthesizer to convert character strings occurring in input text into corresponding phonemic data for use in pronunciation of the input text as synthesized speech. As such, the present invention generated rules (in one or more rule sets) 22 enable a speech synthesizer to produce an audible rendition of the input text.

In a preferred embodiment, the present invention creates rules for suffix, prefix, and infix rule sets for use in the speech synthesizer of U.S. patent application Ser. No. 09/071,441 entitled "COMPUTER METHOD AND APPARATUS FOR TRANSLATING TEXT TO SOUND," referred to previously. Restated, the rule sets disclosed and used in that speech synthesizer may be automatically generated by the present invention.

Table 1 below shows an example of dictionary entries 1 through 11, that may exist in dictionary 21 of FIG. 2.

TABLE 1

EXAMPLE PORTION OF DICTIONARY

| Dictionary Entry | Character String | Phoneme String |
|---|---|---|
| 1 | Ausgleichsverfahren | 'WsglAxsfERf1r@n |
| 2 | Ausverkauf | 'WsfERkWf |
| 3 | abschrägen | 'apSR7g@n |
| 4 | abschwächen | 'apSv7x@n |
| 5 | abschwören | 'apSvqr@n |
| 6 | abschöpfen | 'apSQP@n |
| 7 | abserbeln | 'apzERb@ln |
| 8 | abservieren | 'apzERv3r@n |
| 9 | absichtslos | 'apzIxT14s |
| 10 | absichtsvoll | 'apzIxTfcl |
| 11 | absingen | 'apzIG@n |

In Table 1, each dictionary entry 1 through 11 contains (a) a character string (middle column) comprising one or more characters, and (b) a phoneme string (right hand column) comprising one or more phonemic data parts. For each dictionary entry, there is a correspondence between the phonemic data parts and substrings of the character string of the subject dictionary entry. For example, in Dictionary Entry 1 of Table 1, the phonemic data part "Wsgl" corresponds to character substring "Ausgl", the phonemic data part "r@n" corresponds to character substring "ren"; and so on.

In linguistic terms, the above character substrings are "subgraphs", or "grapheme" strings (each character being a "grapheme"), and the phonemic data parts are "phonemes" or "phoneme" strings.

In a preferred embodiment, each rule 22 (FIG. 2) generated by the present invention specifies (i) the grapheme string portion (i.e., written representation) of the subject input text, (ii) an indication of under which conditions the rule applies (e.g., qualifying surrounding environment of the subject text string), and (iii) the corresponding phonemic data (or phoneme string).

Within a rule set, rules may be generated and then arranged in order of length of the grapheme string (i.e., character substring) to which the rule applies. Thus, a rule specifying the grapheme string of longest length may be listed first in a generated rule set; a rule specifying a grapheme string of second longest length may be listed next, and so forth. Secondarily, for rules specifying grapheme strings of the same length, these rules may additionally be arranged in alphabetical order of their grapheme strings. Table 2 below is illustrative of a portion of a generated rule set 22 (FIG. 2).

TABLE 2

EXAMPLE PORTION OF SUFFIX RULE SET

| | Grapheme String | Phonemic Data (Phoneme String) | Conditions |
|---|---|---|---|
| Rule 1 | -able | > xbl | /-# |
| Rule 2 | -ings | > IGz | /-# |
| Rule 3 | -less | > l\|s | /-# |
| Rule 4 | -ment | > mxnt | /-# |
| Rule 5 | -ness | > n\|s | /-# |
| Rule 6 | -ship | > S\|p | /-# |
| Rule 7 | -dom | > dxm | /-# |
| Rule 8 | -ers | > Rz | /-# |
| Rule 9 | -ful | > fl | /-# |
| Rule 10 | -ify | > \|fA | /-# |

In particular, Table 2 illustrates an example portion of a suffix rule set 22 for English character strings, as may be generated by rule generator 20 (FIG. 2) of the present invention. Ten rules are shown, each for converting a respective ending character substring listed under the column headed "Grapheme String", to corresponding phonemic data listed under the column similarly headed. Conditions under which a rule applies are encoded in the last column where "/–#" means that the grapheme string must be followed by a word boundary. Likewise, "/#–" would mean that the grapheme string must be preceded by a word boundary; i.e., thus the grapheme string is a prefix. For example, Rule 9 is used to convert the grapheme string "ful," occurring at the end of character strings (e.g., in words like "careful", "hopeful" and "thoughtful") to phonemic data "fl".

Rules 1 through 6 are for ending character substrings (grapheme strings) that are each four characters long and thus precede rules 7 through 10 which apply to ending character substrings/grapheme strings that are only three characters long. Within Rules 1 through 6, the rules appear in alphabetical order of respective grapheme strings. Rules 7 through 10 are similarly sorted amongst each other according to alphabetical order of their respective grapheme strings.

It is understood that an actual suffix rule set that is generated by the present invention may be much larger than Table 2, and may also contain other information used for processing the subject ending character substring/grapheme string. The example rule layout and rule set organization shown in Table 2 above is shown as a simplified example only, and the invention is not limited to generation of rules or rule sets structured as those illustrated in Table 2.

In the preferred embodiment, a prefix rule set and infix rule set are similarly generated and configured like the suffix rule set described above in Table 2, except that they contain rules for processing beginning character substrings and intermediate portions, respectively, of input text to be translated to speech. That is, the prefix rule set contains a multiplicity of rules that map respective beginning character substrings to corresponding phoneme strings. The infix rule set contains a multiplicity of rules that map respective character substrings commonly occurring in intermediate locations of input text, to corresponding phoneme strings.

Further, Table 2 is illustrative of the combination of (i) a grapheme string (character substring) extracted from a dictionary entry's character string and (ii) the grapheme string's corresponding phonemic data, to form a rule. The present invention rule set generator 20 (FIG. 2) automatically generates such rules, by examining dictionary 21 entries such as those illustrated in Table 1. A discussion of the processing that takes place to generate grapheme-to-phoneme rules based on dictionary 21 entries is presented next, after a brief set of definitions.

The term "subgraph" is synonymous with "grapheme string" and is defined as one or more graphemes obtained from a character string. A subgraph has an associated size indicating how many characters are in the subgraph. For example, the subgraph "aar" has a size of three, since it is three characters long. A subgraph also has an associated type, such as prefix, suffix or infix. The type indicates the location within a character string from which the subgraph was obtained. Suffix subgraphs are obtained from the end of character strings and include the ending character of the character string. Prefix subgraphs are obtained from the beginning of character strings and include the beginning character. Infix subgraphs are obtained from the middle of character strings and have neither the beginning nor ending character included in the subgraph.

In the word (from Table 1 above) "abservieren" for example, "abser" is a prefix subgraph of length five, "ren" is a suffix subgraph of length three, and "vie" is an infix subgraph of length three.

Figure 3:
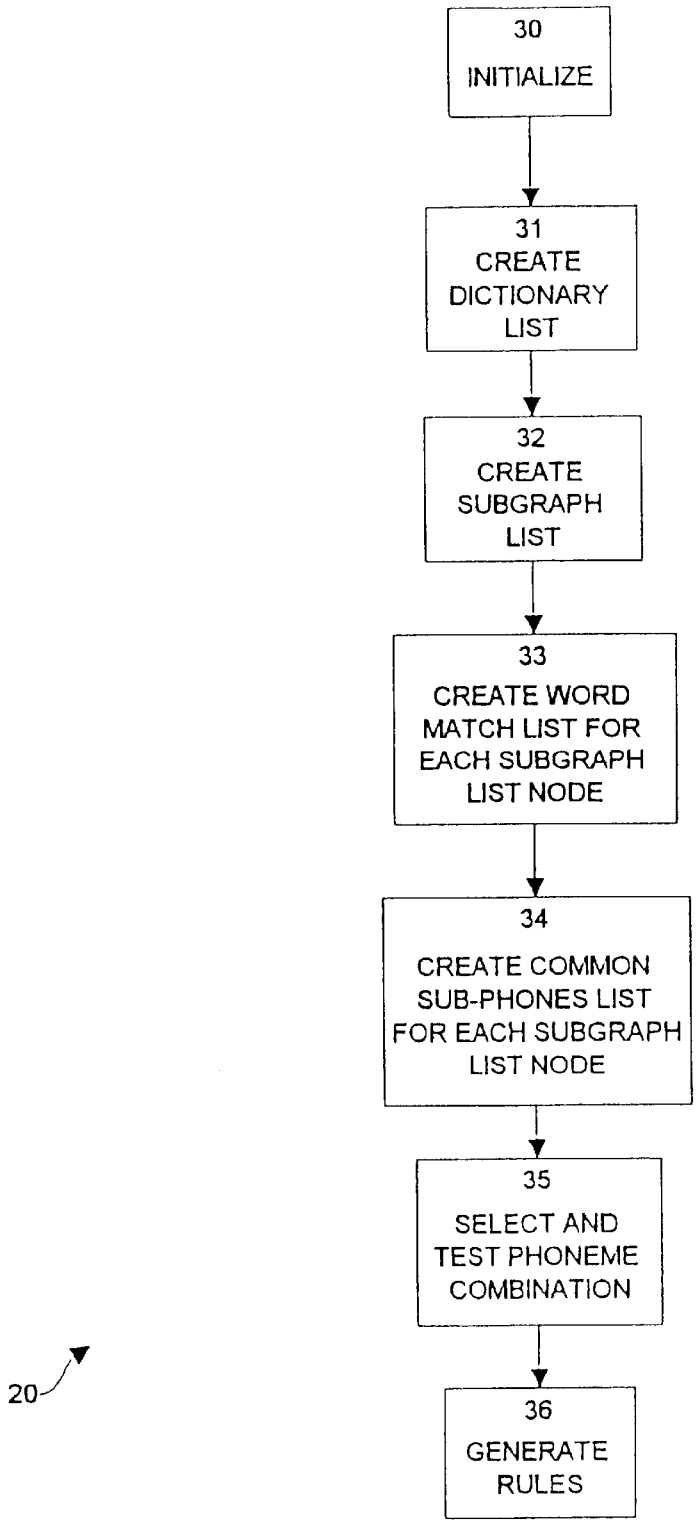
FIG. 3 is a block flow diagram of a preferred embodiment of the rule generator of FIG. 2.

FIG. 3 shows the general processing steps taken by the rule generator 20 of FIG. 2. In an initialization step 30 in FIG. 3, rule generator 20 reads a phoneme table into working memory. The phoneme table encodes all of the possible phonemes for each grapheme (character) in the given language. Since a single character/grapheme, such as the letter "a" may sound different depending upon how it is used within different character strings, there is a different phoneme for each different sound of the character "a". The phoneme table lists a character (grapheme) and each of the possible phonemes that may be associated with that grapheme. As will become apparent later, the phoneme table is used to determine which phonemes match which characters/graphemes in character strings.

Table 3 is an illustration of a phoneme table for the German language.

TABLE 3

EXAMPLE FOR GERMAN LANGUAGE

| Grapheme | Possible phoneme in a single character system |
|---|---|
| a | 1, a |
| b | b, p |
| c | k |
| d | d, t |
| e | 2, E, @ |
| f | f |
| 9 | k, 9 |
| h | x, h or none |
| i | 3, I |
| j | j |
| k | k |
| l | l |

TABLE 3-continued

| EXAMPLE FOR GERMAN LANGUAGE | |
|---|---|
| Grapheme | Possible phoneme in a single character system |
| m | m |
| n | @n, n |
| o | 4, c |
| p | p |
| q | ks, |
| r | r, R |
| s | z, s, T (from ts) |
| t | t |
| u | 5, U |
| v | v, f |
| w | v, f |
| x | ks |
| y | 3, y |
| z | T |
| ä | 7, E |
| ö | Q, q |
| ü | Y |
| β | s |

Figure 4:
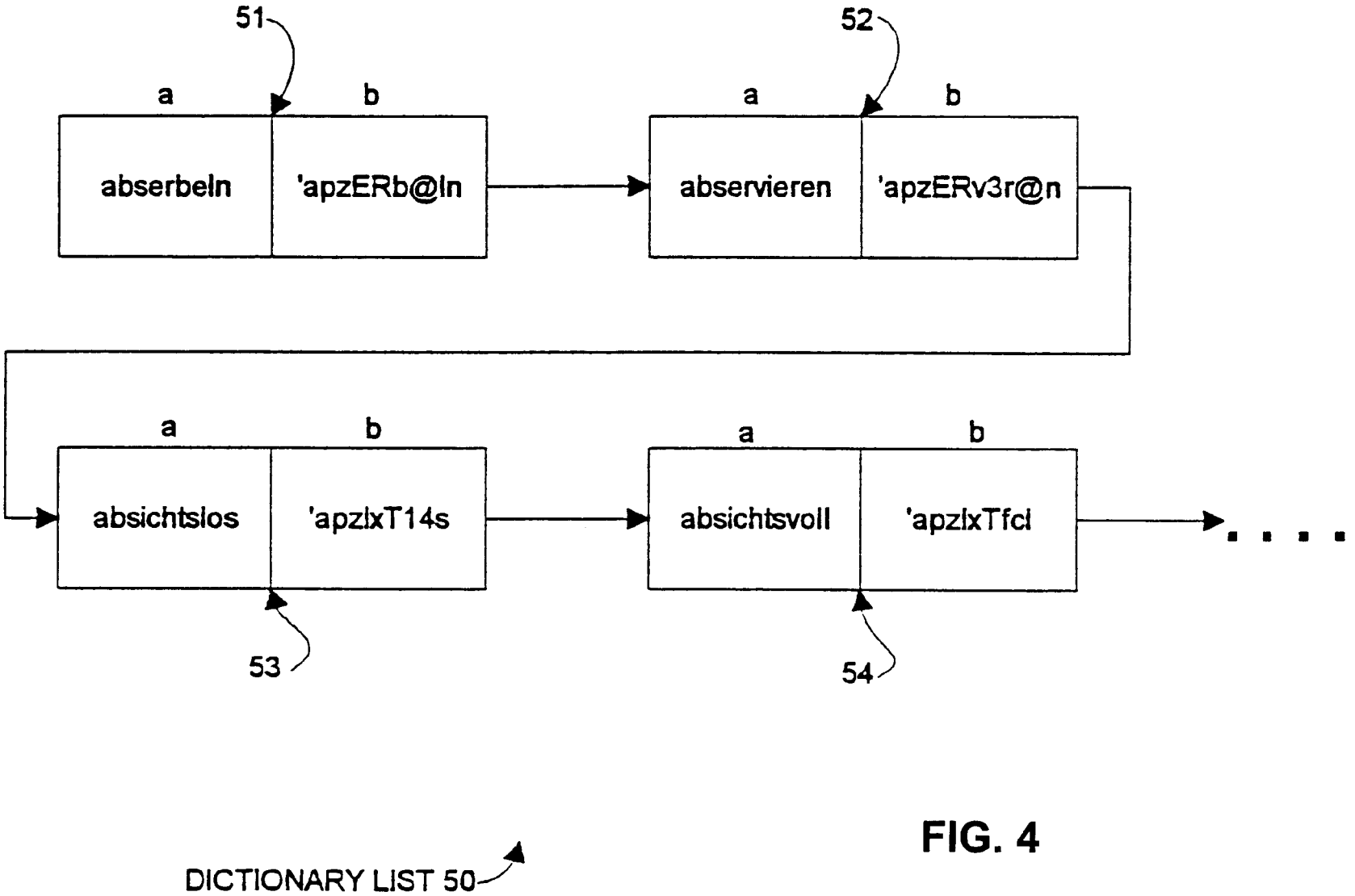
FIG. 4 illustrates a dictionary list structure created by step 31 of FIG. 3.

After the phoneme table has been obtained, step 31 in FIG. 3 creates a dictionary list. In particular, each dictionary entry (such as those in Table 1, for example) is read from the dictionary 21, and each entry's character string and phoneme string is stored in a data structure. FIG. 4 shows an example portion of the dictionary list data structure 50 created by step 31 in the preferred embodiment.

In FIG. 4, each character string 51*a* through 54*a,* and corresponding phoneme string 51*b* through 54*b,* from respective dictionary 21 entries, combine to create dictionary list nodes 51 through 54. Each list node 51 through 54 points to a succeeding dictionary list node to form a linked list data structure. Other data structures are suitable. Only four character string/phoneme string dictionary list nodes are shown in FIG. 4 for clarity in illustrating the dictionary list 50. It is understood that, during processing of step 31 (FIG. 3), there is a respective dictionary list node created for each dictionary entry in dictionary 21.

The dictionary list 50 holding dictionary entries in a linked list fashion is preferably stored in working memory 13 (FIG. 1) to speed up rule generation processing. Alternatively, the dictionary list 50 may be created and stored on a disk for example, or the dictionary 21 itself could serve the purpose of the dictionary list.

Returning to FIG. 3, once the dictionary list 50 has been created from the dictionary 21, step 32 creates a subgraph list based on substrings of the character strings (51*a,* 52*a,* . . . ) of the dictionary list nodes 51,52,53,54. In particular, step 32 compares the character string (51*a,* 52*a,* . . . ) of a given node (51, 52 . . . ) in the dictionary list 50 with every successive node's character string in the dictionary list 50. In each comparison, step 32 finds the longest common substring and determines if the longest common substring is in the same relative position within the two character strings being compared. Preferably the comparison searches for the longest common substrings greater than or equal to a predetermined size and including at least one vowel. In one embodiment, the minimum substring size considered is 2 characters long including at least one vowel.

Figure 5:
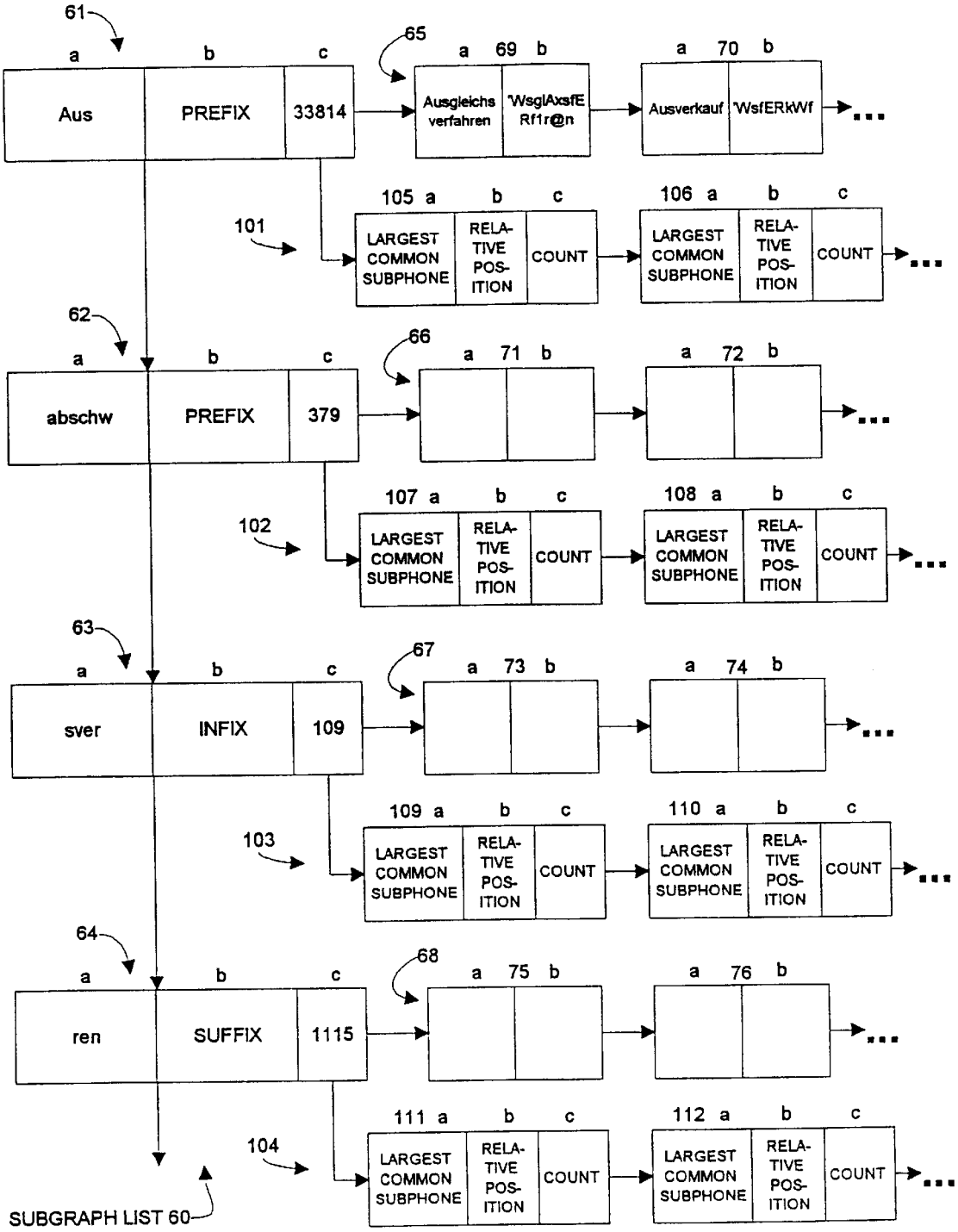
FIG. 5 illustrates a subgraph list structure, a word match list structure, and a subphone list structure created by steps 32 through 34 of FIG. 3.

For each longest common substrings having, respectively, a same relative position in the corresponding compared character strings, a subgraph node (61,62,63,64, FIG. 5) is formed. The qualifying longest common substring is placed into a respective subgraph node (61,62,63,64, FIG. 5), and each subgraph node points to a successive subgraph node to create a linked list 60. That linked list is referred to as the "subgraph list" 60. FIG. 5 illustrates an example portion of a subgraph list 60 formed of subgraph list nodes 61 through 64.

In the preferred embodiment, the first dictionary 50 list node's character string 51*a* is compared to each succeeding node's character string (52*a,*63*a,*54*a,* . . . ) in the dictionary list 50. The qualifying (i.e., same relative string position) longest common substring from each comparison is used to form a respective node of subgraph list 60. After all such subgraph list nodes are generated from said comparisons to the first dictionary list node 51, the second dictionary list node's character string 52*a* is compared to respective succeeding dictionary list node's character strings, just as was done with the character string of the dictionary list first node 51. The longest qualifying common substrings from each of these comparisons are used to form respective subgraph list 60 nodes and so on with each node of dictionary list 50.

It is noted that for a given dictionary list node 51,52,53,54 only character strings in succeeding nodes of the dictionary list 50 need to be considered because comparisons between the subject node character string and previous node's character strings will have already taken place. Further, the linked list structure of dictionary list 50 enables the foregoing node to succeeding node processing (comparisons).

Continuing with the description of subgraph list 60 (FIG. 5), each subgraph node 61, 62, 63, 64 has a substring field (61*a,*62*a,*63*a,* . . . ), and a substring-type field (61*b,*62*b,*63*b,* . . . ). The substring field 61*a,*62*a,*63*a,*64*a* holds the respective longest qualifying common substring as discussed above. The substring-type field 61*b,*62*b,*63*b* indicates where the corresponding substring (i.e., longest common substring) 61*a,*62*a,*63*a,*64*a* occurred within the respective compared dictionary list nodes character strings. Preferably, the substring-type indication identifies the corresponding character string location as either "prefix", "infix" or "suffix". Duplicate substrings of the same substring type (character string position) are not repeated as respective nodes in the subgraph list 60. That is, each subgraph list 60 node has a different substring and substring-type pair.

Further, in the preferred embodiment, the subgraph nodes 61, . . . 64 are arranged in the subgraph list 60 sorted first by length of respective substring 61*a,*62*a* . . . and then by alphabetical order among substrings of the same length.

Referring back to FIG. 3 in step 33, each node 61,62,63, 64 of the subgraph list 60 is then processed as follows to provide a respective word match list 65,66,67,68 (FIG. 5) for the subject subgraph list node 61,62,63,64. Recall that subgraph list node 61,62,63,64 indicates a substring and a corresponding character string location. For each subgraph list node 61,62,63,64, the substring of that node is compared against the character strings of the nodes in dictionary list 50. Each dictionary list node character string that contains the subject substring 61*a,*62*a,*63*a,*64*a* of the subgraph list node 61,62,63,64 is placed in a respective word match list node 69,70,71 . . . 76 (FIG. 5). Also inserted in each word match list node 69,70,71 . . . 76 (FIG. 5) is the corresponding phoneme string of the character string in the word match list node. Thus, the resulting nodes in the word match lists 65,66,67,68 of a given subgraph list node 61,62,63,64 have (i) a character string from a dictionary list node 51,52,53,54 (FIG. 4), the character string containing the substring of the subject subgraph list node, and (ii) the corresponding phoneme string for the character string of (i).

Further, in a given word match list (say 65,66,67,68), each word match list node 69 is linked to a succeeding word match list node 70 such that a linked list is formed under the respective subgraph list node 61 as illustrated in FIG. 5. In the preferred embodiment, the subject subgraph list node 61 also has a count field 61*c* which indicates the total number of entries or nodes 69,70 in the word match list 65 formed for that subgraph list node 61.

Thus, in the example of FIG. 5, subgraph list node 61 has a respective word match list 65. As indicated in the count field 61*c* of subgraph list node 61, respective word match list 65 is formed of 33814 nodes 69,70 . . . Each word match list node 69,70 has (i) a respective character string 69*a,*70*a,* (ii) the phoneme string 69*b,*70*b* corresponding to the character string 69*a,*70*a,* and (iii) a pointer or suitable link to the succeeding node in that word match list 65.

Likewise, subgraph list node 62 has a respective word match list 66 formed of nodes 71,72 . . . The count field 62*c* of subgraph list node 62 indicates 379 such word match list nodes 71,72 linked together to form word match list 66. Each node 71,72 in word match list 66 has (i) a respective character string 71*a,*72*a,* (ii) a corresponding phoneme string 71*b,*72*b,* and (iii) a suitable link (e.g., pointer) to the succeeding node in that word match list 66.

Similarly, subgraph list nodes 63,64 each have a respective word match list 67,68 respectively. The count field 63*c* of subgraph list node 63 indicates 1109 word match list nodes 73,74. The count field 64*c* of subgraph list node 64 indicates 1115 nodes 75,76 in respective word match list 68. Each node 73,74,75,76 in the word match lists 67,68 has (i) a respective character string 73*a,*74*a,*75*a,*76*a,* (ii) a corresponding phoneme string 73*b,*74*b,*75*b,*76*b,* and (iii) appropriate linking means (e.g., a pointer) to the succeeding node in the respective word match list 67,68.

After the word match lists 65–68 for each subgraph list node 61,62,63,64 has been constructed, then a respective subphone list 101–104 is constructed for each subgraph list node 61,62,63,64 as follows. In a given word match list (say for example 65) of a respective subgraph list node 61, each node 69,70 in that word match list 65 is formed of a character string 69*a,*70*a* and corresponding phoneme string 69*b,*70*b*. The phoneme strings 69*b,*70*b* of the nodes 69,70 in the word match list 65 are compared against each other, to find the longest common phoneme substrings that are in the same relative location of the corresponding character strings 69*a,*70*a*. Preferably only the longest common phoneme substrings greater than or equal to a predetermined size (e.g., 2 characters long) are considered.

That is, the first phoneme string 69*b* in the word match list 65 is compared against the phoneme strings 70*b* of the succeeding node 70 in the word match list 65. The longest common phoneme substring between the two phoneme strings 69*b,*70*b* are determined. For each longest common phoneme substring, the present invention determines the corresponding characters in the first character string 69*a* and the corresponding characters in the character string 70*a* of the subject succeeding node 70. If the relative position/location (e.g., prefix, infix, suffix position) of the corresponding characters in the first character string 69*a* is the same as the relative position of the corresponding characters in the subject succeeding node character string 70*a,* then the subject longest common phoneme substring is stored in a respective node 105 (part a) and an indication of the relative position is stored in the respective node 105 (part b) in the subphone list 101.

The first phoneme string 69*b* is similarly compared to and processed with respect to the phoneme strings of nodes succeeding node 70 in subject word match list 65, to form other nodes 106 (part a and b) of the corresponding subphone list 101. Likewise, the phoneme string in each succeeding word match list node 70 is compared to and processed with respect to its succeeding word match list nodes' phoneme strings. Each determined qualifying longest common phoneme substring and relative character string position is used to form respective nodes 106 in the corresponding subphone list 101.

The foregoing phoneme string comparison process is repeated for each word match list 66–68, to form respective subphone lists 102–104 with nodes 107,108,109,110,111, 112, respectively, as shown in FIG. 5. Node parts 105*a,* 106*a,*107*a,*108*a,*109*a* . . . 112*a* hold respective indications of the longest common phoneme substring determined from said comparisons, while node parts 105*b,*106*b* . . . 112*b* hold respective indications of relative character string location/position. Each of the formed subphone list 101–104 are preferably structured as a linked list. As such, in each subphone list 101–104, each node 105,106,107,108, 109, 110,111,112 points to a succeeding node.

Further, in each subphone list node 105,106,107,108, 109,110,111,112, there is a count field 105*c,*106*c,*107*c* . . . 112*c*. The count field 105*c*–112*c* of a subphone list node 105–112 indicates the number of times the node's subphone (longest common phoneme substring) 105*a*–112*a* occurs in the corresponding word match list 65–68.

Referring back to FIG. 3, after step 34, the subgraph list 60, word match list 65,68 and subphone lists 101–104 hierarchy of FIG. 5 is completed and enables the following analysis (step 35). For each node 69–76 in a given word match list 65–68, the phoneme string 69*b*–76*b* of that node is analyzed with respect to nodes of the corresponding subphone list 101–104. In particular, based on the word/character string location indicated in the subject subgraph list node 61*b*–64*b,* an entry (node 105 . . . 112) from the corresponding subphone list 101–104 is selected. If the subgraph node 61*b* . . . 64*b* and the selected subphone list entry 105*b* . . . 112*b* indicate a prefix character string location, then the last phoneme of the subphone list entry (longest common phoneme substring) 105*a* . . . 112*a* must be a possible phoneme for the last character of the substring in the corresponding subgraph list node 61*a,* . . . 64*a*. If the subgraph list node 61*b* . . . 64*b* and selected subphone list entry 105*b* . . . 112*b* indicates a suffix character string position, then the first phoneme of the subphone list node 105*a* . . . 112*a* must be a possible phoneme of the first character of the substring in the corresponding subgraph list node 61*a* . . . 64*a*. If the subgraph list node 61*b* . . . 64*b* and selected subphone list node entry 105*b* . . . 112*b* is indicated to be a string location type for the middle of a character string, then both of the above must be met. Each of the foregoing determinations is made utilizing the phoneme table obtained and stored during initialization step 30 discussed above.

In the preferred embodiment, subphone list 101–104 not only has a corresponding relative string location (indicated at node part 105*b* . . . 112*b*) matching that of the corresponding subgraph list node 61*b* . . . 64*b* but also selected from the largest number in the count field 105*c* . . . 112*c*. That node 105 . . . 112 effectively indicates the most common subphone 105*a* . . . 112*a* in that subphone list 101 . . . 104.

In addition, in the preferred embodiment, the subphone list node 105 . . . 112 is selected based on length of the corresponding subphone 105*a* . . . 112*a*. Preferably, the length of the subject subphone string 105*a* . . . 112*a* must be greater than the number of characters in the substring 61*a* . . . 64*a* of the corresponding subgraph list 60 node minus a predetermined parameter. The predetermined parameter is used to effectively control the number of rules in the final rule set by eliminating rules that are not efficient in converting grapheme to phonemes. Depending on the language, the predetermined parameter is between −2 and +2. For the English language, the predetermined parameter equals 1, for example.

The resulting selected subphone list entry 105 . . . 112 from the above processing is then used in step 36 of FIG. 3 to generate a rule for the corresponding subgraph list node 61 . . . 64 as follows. A rule is created stating that the substring of characters 61*a* . . . 64*a* in the corresponding subgraph list node 61 . . . 64, at the character string location 61*b* . . . 64*b* indicated by that subgraph list node 61 . . . 64 has a phoneme string of the selected subphone list entry/node (part a) 105*a* . . . 112*a*.

Figure 6:
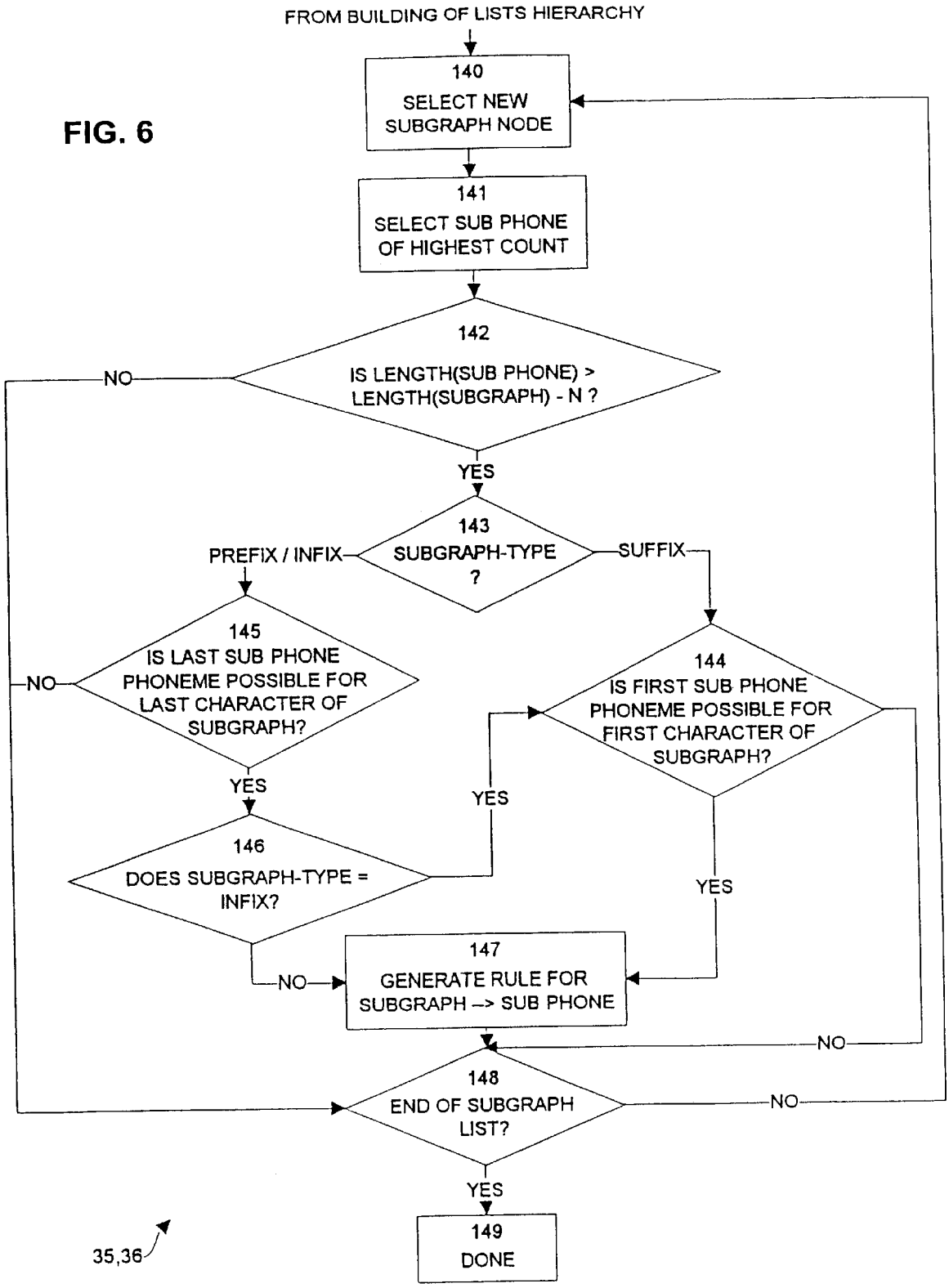
FIG. 6 is a flow diagram of steps 35, 36 in FIG. 3 generating rules according to the preferred embodiment of the invention.

The foregoing steps 35 and 36 are performed for each subgraph list node 61 . . . 64 to generate a plurality of rules for the initial dictionary/dictionary list 50. FIG. 6 further illustrates the logic flow of steps 35 and 36 in the preferred embodiment.

The processing of FIG. 6 begins at step 140, which selects the first node 61 of the subgraph list 60. Step 141 in FIG. 6 then traverses the corresponding subphone list 101 for that subgraph list node 61 and conditionally selects the subphone node 106 with the highest count 105*c*.

Once step 141 selects the subphone node 106 with the highest count, step 142 in FIG. 6 determines whether a length condition is satisfied. If the string length of the selected subphone (phoneme substring) 106*a* is greater than the string length of the subject character string 61*a* of subgraph node 61 minus a constant N, then the length condition is met and processing proceeds to step 143. N is the predetermined parameter discussed above. If the length condition is not met, then processing returns to step 140 where the next subgraph list node 62 is processed. Thus, step 142 ensures that a subphone 105*a* . . . 112*a* used in a rule meets a minimum length. Step 142 may be used to control the final rule set size by adjusting constant N to eliminate rules having short subphones (phoneme strings) as discussed above.

If step 142 determines that the subphone 106*a* is of adequate length, step 143 examines the phoneme/grapheme compatibility of selected subphone 106*a* and subject subgraph 61*a*. In particular, step 143 determines (from subgraph list node 61*b*) the subgraph type or relative character string location. If the subgraph-type is either prefix or infix, step 145 is executed next. Otherwise, (i.e., if the subgraph type is suffix), step 144 is processed. Steps 144 and 145 check the selected subphone 106*a* against the phoneme table.

In particular, in step 145 if the subgraph type 61*b* is prefix or infix, then the selected subphone 106*a* is checked for beginning-of-character-string usage. In such usage, the last phoneme of selected subphone 106*a* must be a possible phoneme for the last character of the subject subgraph 61*a*. If the phoneme table affirms that the last phoneme of selected subphone 106*a* is a possible phoneme for the last character of subgraph 61*a*, then step 146 is processed. If not, then the process loops back to step 140 to process the next subgraph list node 62.

If the subgraph type 61*b* is infix, then step 146 proceeds to step 144. This effectively provides checking of infix subgraphs 61*a* first as a prefix (step 145) then as a suffix (step 144). For a suffix or infix subgraph 61*a*, step 144 checks the phoneme table for end-of-string usage of selected subphone 106*a*. If the first phoneme of the selected subphone 106*a* is a possible phoneme of the first character of the subject subgraph 61*a* according to the phoneme table, then processing proceeds to step 147. If not, then the process restarts at step 140 with the next subgraph list node 62.

After the selected subphone 106 has met the count condition (step 141), the length condition (step 142), and the grapheme/phoneme compatibility condition (step 144, 145), it is paired with its corresponding subgraph 61*a* to become a rule (step 147). Specifically, step 147 employs the selected subphone 106*a* as the phonemic data portion of a rule, and the subject subgraph 61*a* as the grapheme string portion. As shown in Table 2 above, such rules encode the subgraph to phoneme string/substring transformation for text-to-speech synthesizers.

After step 147, step 148 (FIG. 6) provides a loop to continue processing each node of subgraph list 60 (FIG. 5). After the last of such nodes, step 149 completes the processing 35,36 of FIG. 6.

It may now be apparent to those skilled in the art that the present invention can easily generate rule sets for text-to-speech synthesizers. Specifically, prefix, suffix and infix rule sets are discussed in the aforementioned patent application. The present invention may create each of these rule sets simply based upon subgraph-type 61*b* . . . 64*b*. That is, as each rule is generated in step 147 of FIG. 6, if the subgraph-type for the subject subgraph 61*a* (i.e.,grapheme string) of the rule is a prefix, then the rule may be stored in a prefix rule set and if the subgraph type is a suffix, then the rule may be stored in the suffix rule set. Likewise, infix rules generated from infix substrings may be stored in infix rule sets.

Note that the present invention is not required to create suffix, prefix and infix rule sets, and could place all rules in a single rule set. However, multiple rule sets are advantageous to text-to-speech processing as discussed in the aforementioned patent application.

It should also now be apparent to those skilled in the art that the invention is not limited to using linked lists and the list node processing as discussed above. Those skilled in data processing, programming, list management, data structures, statistical counting techniques and general system design may readily envision alternative methods, systems, and apparatus that may embody the invention, or that may vary from the above design. Thus, the above design is not meant to limit the scope of the present invention. Alternative uses of queues, stacks, heaps, lists, arrays, loops, and other programming techniques can accomplish the same objectives as the list processing and linked lists disclosed herein as examples. These alternative methods are contemplated herein and are within the scope of the present invention.

Other alternative processing strategies are also intended to be part of the invention as described. For instance, instead of maintaining each list shown in FIGS. 4 and 5 in memory during processing, this data may be stored on disk or by another means while other lists are being generated. Since dictionaries used by the invention may be large, portions of the word list for example may be swapped in and out of memory as needed while performing associated processing.

Distributed data processing may be used by the invention to break up the processing of lists and rule generation. For example, the invention may create separate lists for subgraphs (substrings) of different subgraph-types, and distribute these lists to separate processing units. Then, the ancillary lists, such as the word match lists and subphone lists, may be generated on individual processing units for an overall increase in the speed of calculations. Rule generation for the separate rule sets may be performed on separate machines which may also decrease rule set generation time. The invention does not have to be implemented on a serial single computer system.

Moreover, the arrangement of the overall processing of the invention, such as the steps shown in FIG. 6, may be altered while still accomplishing the objectives of the present invention. For example, the length and count conditions tested in steps 142 and 141 could be reversed and the objectives of the invention may still be accomplished. The apparatus and processing steps shown in each of the figures are merely illustrative of a preferred embodiment of the invention, and are not meant to limit the invention to just those embodiments.

As briefly noted earlier, the embodiments of the invention may be implemented on a computer data processing system such as that shown in FIG. 1. In FIG. 1, the computer system 06 comprises inter-coupled components 01–05. The computer system 06 generally includes an interconnection mechanism 05 coupling an input device 01, a processor 02, a storage device 03 and an output device 04.

The input device 01 receives data in the form of commands, computer programs or data files such as text files and other information as input to the computer system 06 from users or other input sources. Typical examples of input devices include a keyboard, a mouse, data sensors, and a network interface connected to a network to receive another computer system's output.

The interconnection mechanism 05 allows data and processing control signals to be exchanged between the various components 01–04 of the computer system 06. Common examples of an interconnection mechanism are a data bus, circuitry, and in the case of a distributed computer system, a network or communication link between each of the components 01–04 of computer system 06.

The storage device 03 stores data such as text to be synthesized into speech and executable computer programs for access by the computer system 06. Typical storage devices may include computer memory and non-volatile memory such as hard disks, optical disks, or file servers locally attached to the computer system 06 or accessible over a computer network.

The processor 02 executes computer programs loaded into the computer system 06 from the input or storage devices. Typical examples of processors are Intel's Pentium, Pentium II, and the 80x86 series of microprocessors; Sun Microsystems's SPARC series of workstation processors; as well as dedicated application specific integrated circuits (ASIC's). The processor 02 may also be any other microprocessor commonly used in computers for performing information processing.

The output device 04 is used to output information from the computer system 06. Typical output devices may be computer monitors, LCD screens or printers, speakers or recording devices, or network connections linking the computer system 06 to other computers. Computer systems such as that shown in FIG. 1 commonly have multiple input, output and storage devices as well as multiple processors.

Generally, in operation, the computer system 06 shown in FIG. 1 is controlled by an operating system. Typical examples of operating systems are MS-DOS and Windows95 from Microsoft Corporation, or Solaris and SunOS from Sun Microsystems, Inc. As the computer system 06 operates, input such as text data, text file or Web page data, programs, commands, and dictionary data, received from users or other processing systems, may be temporarily stored on storage device 03. Certain commands cause the processor 02 to retrieve and execute stored programs, such as a program implementing the rule set generation processes discussed above.

The programs executing on the processor 02 may obtain more data from the same or a different input device, such as a network connection providing dictionary data. The programs may also access data in a database or file for example, and commands and other input data may cause the processor 02 to begin rule set generation and perform other operations on the dictionary in relation to other input data. Rule sets may be generated which are sent to the output device 04 to be saved as prefix, infix and suffix rule sets. The output data may be held for transmission to another computer system or device for further processing.

Typical examples of the computer system 06 are personal computers and workstations, hand-held computers, dedicated computers designed for a specific speech synthesis purposes, and large main frame computers suited for use by many users. The invention is not limited to being implemented on any specific type of computer system or data processing device, nor is it limited to a single processing device.

It is noted that the invention may also be implemented purely in hardware or circuitry which embodies the logic and speech processing disclosed herein, or alternatively, the invention may be implemented purely in software in the form of a rule set generation software package, or other type of program stored on a computer readable medium, such as the storage device 03 shown in FIG. 1. In the later case, the invention in the form of computer program logic and executable instructions is read and executed by the processor 02 and instructs the computer system 06 to perform the functionality disclosed as the invention herein.

If the invention is embodied as a computer program or as software on a disk, the computer program logic is not limited to being implemented in any specific programming language. For example, commonly used programming languages such as C, C++, and JAVA, as well as others, such as list processing languages may be used to implement the logic and functionality of the invention. Furthermore, the subject matter of the invention is not limited to currently existing computer processing devices or programming languages, but rather, is meant to be able to be implemented in many different types of environments in both hardware and software.

Furthermore, combinations of embodiments of the invention may be divided into specific functions and implemented on different individual computer processing devices and systems which may be interconnected to communicate and interact with each other. Dividing up the functionality of the invention between several different computers is meant to be covered within the scope of the invention.

EQUIVALENTS

While this invention has been particularly shown and described with references to a preferred embodiment thereof, it will be understood by those skilled in the art that various changes may be made therein without departing from the spirit and scope of the invention as defined by the following claims.

For example, the foregoing discussions and descriptions of dictionary list 50, subgraph list 60, word match lists 65–68 and subphone lists 101–104 recite a sequence of nodes with pointers from one node to a succeeding node. Other means for linking, associating, grouping or otherwise coupling a set or group of nodes together to effectively form or provide the function of the described linked lists 50,60, 65–68 and 101–104 are suitable. Likewise, other structures besides linked lists for forming dictionary list 50, subgraph list 60, word match lists 65–68 and subphone lists 101–104 are suitable as previously mentioned.

Overall, the present invention hierarchical lists (i.e., subgraph list 60, corresponding word match lists 65–68 and subphone lists 101–104), formed of respective nodes and nodal information, provide a working structure that organizes dictionary information (graphemes, phonemes, substrings of each) in a manner that enables automated grapheme-to-phoneme rule generation. Such organization takes into consideration relative string location, frequency of usage of phoneme substrings for corresponding subgraphs (substrings of characters) and other language sensitive relationships between phoneme and grapheme substrings (some that are not readily apparent to humans/linguists). This is key to the present method and apparatus for automated generation of desired rules.

In a preferred embodiment, the present invention utilizes a word dictionary with entries limited to alphabetic characters(i.e., entries may not include non-alphabetic symbols). Further, the phoneme symbols (phonemic data parts) used in the dictionary are of a single-character system. That is, one character is used to represent a respective phoneme. Other multiple-character phoneme systems are suitable, as are other types of dictionaries in view of the preceding disclosure of the invention.

In another example, the process or steps used to form the subgraph list 60 not only looks for the longest common subsequence of characters between dictionary list nodes 51,52,53,54, but also checks for minimum size and at least one vowel. In one embodiment, the size threshold is two characters long, but a three or other number of characters minimum size is also suitable. If the common subsequence of characters does not have a vowel (in the given minimum size limit of three characters), then a rule is generated. This is based on the language of the subject dictionary allowing only up to a certain number of consecutive consonants. That number of consecutive consonants is language dependent (e.g., for English it is three).

What is claimed is:

1. In a computer system, a method for generating grapheme-to-phoneme rules, comprising the steps of:

receiving dictionary input formed of a plurality of character string entries, each character string entry (i) being formed of a sequence of one or more characters and (ii) having a corresponding phoneme indication formed of phonemic data parts, a different phonemic data part for different respective subsequence of characters in the character string entry;

for each of the different subsequences of characters in the character string entries, (a) determining respective corresponding phonemic data parts found throughout the dictionary input for the subsequence of characters, and (b) from the determined respective corresponding phonemic data parts for the subsequence of characters, forming a grapheme-to-phoneme rule for indicating transformation from the subsequence of characters to at least one of the respective corresponding phonemic data parts, such that grapheme-to-phoneme rules are generated from the dictionary input.

2. A method as claimed in claim 1, wherein the step of determining respective corresponding phonemic data parts of a subsequence of characters includes determining relative frequency among the respective corresponding phonemic data parts.

3. A method as claimed in claim 2 wherein the step of forming a grapheme-to-phoneme rule includes forming a grapheme-to-phoneme rule for indicating transformation from the subsequence of characters to the phonemic data part most frequently corresponding to the subsequence of characters throughout the dictionary input.

4. A method as in claimed claim 1 wherein the step of receiving dictionary input further includes the step of linking each character string entry to another character string entry to form a dictionary linked list of the plurality of character string entries.

5. A method as claimed in claim 4 wherein the step of determining respective corresponding phonemic data parts of a subsequence of characters further includes the steps of:

for each character string entry in the dictionary linked list, comparing the character string entry to each of the succeeding character string entries in the dictionary linked list;

for each comparison between a character string entry and a succeeding character string entry, determining a longest common subsequence of characters having a same respective location within the character string entries, the location being one of prefix, infix and suffix positions of a character string entry;

storing in a linked list fashion, each determined longest common subsequence of characters and corresponding indication of location within the character string entries, each determined longest common subsequence of characters and its corresponding indication of location being a subgraph entry, such that a subgraph linked list is formed; and sorting the subgraph entries of the formed subgraph linked list such that the subgraph entry having the longest subsequence of characters is first in the subgraph linked list, and any subgraph entry repeating another subgraph entry is omitted.

6. A method as claimed in claim 5 wherein the step of sorting further includes, for subgraph entries having subsequences of a same length, sorting the subsequences alphabetically.

7. A method as claimed in claim 5 further comprising the steps of:

for each subgraph entry in the subgraph linked list, (A) determining which character string entries from the dictionary input have the subsequence of characters in the corresponding location of the subgraph entry;

(B) for each determined character string entry, forming a word match entry, including indicating the corresponding phoneme of the determined character string entry; and (C) linking the formed word match entries to each other and to the subgraph entry, such that a word match linked list is formed for and coupled to the subgraph entry.

8. A method as claimed in claim 7 further comprising the steps of:

(i) for each word match entry in the word match linked list of the subgraph entry, comparing the phoneme indicated in the word match entry to phonemes indicated in succeeding word match entries, and finding a largest common phonemic data part of a same relative location in the phonemes;

(ii) for each found largest common phonemic data part, determining an occurrence count of number of word match entries in which the phonemic data part occurs;

(iii) for each found largest common phonemic data part, forming a subphone entry indicating (a) the found largest common phonemic data part, (b) its corresponding location in the phonemes in terms of prefix, infix and suffix positions, and (c) the determined occurrence count;

(iv) using pointers, linking the formed subphone entries to each other and to the subgraph entry, such that a subphone linked list is formed for and coupled to the subgraph entry.

9. A method as claimed in claim 8, wherein the step of forming a grapheme-to-phoneme rule further comprises the step of, for each word match entry in the word match linked list of a subgraph entry:

selecting from the subphone linked list of the subgraph entry, a subphone entry having phonemic data parts matching the phonemic data parts of the phoneme indicated in the word match entry and having a same corresponding location as the subgraph entry; and generating a grapheme-to-phoneme rule using the selected subphone entry, such that the rule indicates that the subsequence of characters in the subgraph entry occurring at its corresponding location within a character string, has a phonemic translation of the phonemic data parts of the selected subphone entry.

10. A method as claimed in claim 9 wherein the step of selecting a subphone entry further includes the steps of:

if the corresponding location indicated in the subphone entry is prefix, verifying that a last phonemic data part of the subphone entry is a possible phonemic data part for a last character of the subgraph entry;

if the corresponding location indicated in the subphone entry is suffix, verifying that a first phonemic data part of the subphone entry is a possible phonemic data part for a first character of the subgraph entry;

if the corresponding location indicated in the subphone entry is infix, verifying that a last phonemic data part of the subphone entry is a possible phonemic data part for a last character grapheme of the subgraph entry and that a first phonemic data part of the subphone entry is a possible phonemic data part for a first character of the subgraph entry;

determining the subphone entry having a highest occurrence count; and verifying that length of the phonemic data parts of the subphone entry is greater than length of the sequence of characters in the subgraph entry adjusted by a predetermined amount.

11. A computer system for automatically generating grapheme-to-phoneme rules, comprising:

a dictionary input source which provides a plurality of character string entries, each character string entry (i) being formed of a sequence of one or more characters and (ii) having a corresponding phoneme indication formed of phonemic data parts, a different phonemic data part for different respective subsequences of characters in the character string entry; and a rule generator operably responsive to the dictionary input source, automatically to generate grapheme-to-phoneme rules from an analysis of the dictionary input; the rule generator, for each of the different subsequences of characters in the character string entries, (a) determining respective corresponding phonemic data parts found throughout the dictionary input for the subsequence of characters, and (b) from the determined respective corresponding phonemic data parts for the subsequence of characters, forming a grapheme-to-phoneme rule for indicating transformation from the subsequence of characters to at least one of the respective corresponding phonemic data parts, such that grapheme-to-phoneme rules are generated from the dictionary input.

12. A computer system for automatically generating grapheme-to-phoneme rules, comprising:

a dictionary input source which provides a plurality of character string entries, each character string entry (i) being formed of a sequence of one or more characters and (ii) having a corresponding phoneme indication formed of phonemic data parts, a different phonemic data part for different respective subsequences of characters in the character string entry; and a rule generator operably responsive to the dictionary input source, automatically to generate grapheme-to-phoneme rules from an analysis of the dictionary input; wherein the rule generator employs an analysis which includes determining relative occurrence frequency among the respective corresponding phonemic data parts.

13. A computer system as claimed in claim 12 wherein the rule generator forms a grapheme-to-phoneme rule for indicating transformation from the subsequence of characters to the phonemic data part most frequently corresponding to the subsequence of characters throughout the plurality of character string entries.

14. A computer system as claimed in claim 12 wherein the rule generator links each character string entry to another character string entry to form a dictionary linked list of the plurality of character string entries;

for each character string entry in the dictionary linked list, the rule generator compares the character string entry to each of the succeeding character string entries in the dictionary linked list;

for each comparison between a character string entry and a succeeding character string entry, the rule generator determines a longest common subsequence of characters having a same respective location within the character string entries;

the rule generator storing in a linked list fashion, each determined longest common subsequence of characters and corresponding indication of location within the character string entries, each determined longest common subsequence of characters and its corresponding indication of location being a subgraph entry, such that a subgraph linked list is formed;

the rule generator, for each subgraph entry in the subgraph linked list, (A) determining which character string entries from the dictionary input have the subsequence of characters in the corresponding location of the subgraph entry;

(B) for each determined character string entry, forming a word match entry, including indicating the corresponding phoneme of the determined character string entry; and (C) linking the formed word match entries to each other and to the subgraph entry, such that a word match linked list is formed for and coupled to the subgraph entry.

15. A computer system as claimed in claim 14 wherein the rule generator further:

for each word match entry in the word match linked list of the subgraph entry, compares the phoneme indicated in the word match entry to phonemes indicated in succeeding word match entries, and finds a largest common phonemic data part of a same relative location in the phonemes;

for each found largest common phonemic data part, determines an occurrence count of number of word match entries in which the phonemic data part occurs;

for each found largest common phonemic data part, forms a subphone entry indicating (a) the found largest common phonemic data part, (b) its corresponding location in the phonemes in terms of prefix, infix and suffix positions, and (c) the determined occurrence count;

links the formed subphone entries to each other and to the subgraph entry, such that a subphone linked list is formed for and coupled to the subgraph entry;

for each word match entry in the word match linked list of a subgraph entry, selects from the subphone linked list of the subgraph entry, a subphone entry having phonemic data parts matching the phonemic data parts of the phoneme indicated in the word match entry and having a same corresponding location as the subgraph entry; and generates a grapheme-to-phoneme rule using the selected subphone entry, such that the rule indicates that the subsequence of characters in the subgraph entry occurring at its corresponding location within a character string, has a phonemic translation of the phonemic data parts of the selected subphone entry.

16. A computer system as claimed in claim 15 wherein the rule generator further sorts the subgraph entries of the formed subgraph linked list by size such that the subgraph entry having the longest sequence of characters is first in the subgraph linked list, and any subgraph entry repeating another subgraph entry is omitted, and the rule generator further alphabetically sorts subgraph entries having subsequences of the same length.

17. A computer system as claimed in claim 15 further comprising a phoneme table, wherein the rule generator utilizes the phoneme table to:

verify that a last phonemic data part of the subphone entry is a possible phonemic data part for a last character of the subgraph entry, if the corresponding location indicated in the subphone entry is prefix;

verify that a first phonemic data part of the subphone entry is a possible phonemic data part for a first character of the subgraph entry, if the corresponding location indicated in the subphone entry is suffix; and verify that a last phonemic data part of the subphone entry is a possible phonemic data part for a last character grapheme of the subgraph entry and that a first phonemic data part of the subphone entry is a possible phonemic data part for a first character of the subgraph entry, if the corresponding location indicated in the subphone entry is infix.

18. A computer system as claimed in claim 17 wherein the rule generator further verifies that length of the phonemic data parts of the subphone entry is greater than length of the sequence of characters in the subgraph entry adjusted by a predetermined amount.

19. A computer system as claimed in claim 11 wherein:

the rule generator employs a statistical analysis to generate grapheme-to-phoneme rules.

* * * * *